United States Patent [19]

Leins et al.

[11] Patent Number: 4,539,826

[45] Date of Patent: Sep. 10, 1985

[54] KNITTING MACHINE

[75] Inventors: Eberhard Leins, Filderstadt; Manfred Walter, Aichtal, both of Fed. Rep. of Germany

[73] Assignee: Sulzer Morat GmbH, Fed. Rep. of Germany

[21] Appl. No.: 506,283

[22] Filed: Jun. 21, 1983

[30] Foreign Application Priority Data

Jul. 7, 1982 [DE] Fed. Rep. of Germany ..... 3225345

[51] Int. Cl.[3] ..... D04B 7/04

[52] U.S. Cl. ..... 66/64; 66/70

[58] Field of Search ..... 66/75, 75.1, 64, 70

[56] References Cited

U.S. PATENT DOCUMENTS 4,103,517 8/1978 Schmid et al. ..... 66/75.1

4,127,012 11/1978 Schmid et al. ..... 66/75.2

4,282,724 8/1981 Elsässer ..... 66/75.2

*Primary Examiner*—Ronald Feldbaum

[57] ABSTRACT

Knitting machine having two needle beds in which loop-forming knitting needles are mounted for extension and retraction, having disk cams disposed on a revolving drive shaft with an angular offset for the purpose of lifting the knitting needles, and having a patterning apparatus for engaging and disengaging the knitting needles and the cams according to the pattern, such that only engaged knitting needles can be raised by the disk cams, a transfer device being provided, which is intended for the transfer of loops formed on knitting needles of at least one needle bed to associated knitting needles of the other needle bed. This transfer device can control the coupling produced by means of the patterning apparatus between the disk cams and the knitting needles such that the knitting needles can be extended selectively by the disk cams into a knit position or into a transfer position (FIG. 1).

28 Claims, 11 Drawing Figures

KNITTING MACHINE

BACKGROUND OF THE INVENTION

The invention relates to a knitting machine of the kind defined in the general part of claim 1.

Known knitting machines of this kind (DE-AS No. 1,296,733, DE-OS No. 25 31 762), which are distinguished from flat knitting machines of the prior art which have a reciprocating or circulating carriage particularly in having greater numbers of systems, greater knitting speeds and consequently greater production capacity, are still limited in their applications. In particular, no such knitting machines have become known which are equipped with means for the transfer of loops formed on one needle bed to the needles of the other needle bed, so that ribbed edges and textured patterns cannot be made with these knitting machines.

The transfer of loops has heretofore been known only in conventional knitting machines. Ordinary flat knitting machines have for this purpose, for example, knitting and transfer cams disposed successively in the direction of movement of the carriage or combined knitting and transfer cams (DE-AS No. 24 43 231, DE-OS No. 27 20 750 and DE-OS No. 30 19 036, or PCT-OS WO No. 81/00868). While the selection of the needles to cast off does not involve any problems if special drivers are used, when combination knitting and transfer cams are used, a driver is provided, as a rule, which can be operated only for the transfer action, or a cam switch is disposed between a knitting cam and an additional driver. In that case, those knitting tools which are to transfer the loops are prepared for the transfer action by first being selected by means of a patterning system as in the case of a normal knit or tuck action, and then being driven by the activated driver or cam switch to the transfer position above the knitting level. This results in the advantage that conventional and, in case of necessity, also for tucking, and an additional patterning means can be used for the selection of the knitting needles, and can be programmed for knitting and, in case of necessity, also for tacking, and an additional patterning command is needed only for the operation of the driver or cam switch.

Such transfer means are not directly applicable to knitting machines of the kind specified in the introduction, because in these machines the knitting needle extension and retraction strokes are controlled not by plate cams but by disk cams operatively connected to the knitting tools, and therefore special drivers or cam switches cannot be used. In such knitting machines, therefore, the only patterning devices that have been conceivable heretofore are those in which a fourfold selection is possible ("missknit", "tuck", "knit" and "transfer"), or the selection "tuck"must be dispensed with. A fourfold selector is complex and expensive regardless of the kind of patterning means used, but it is not desirable to dispense with the selection "tuck" precisely where the transfer of loops is involved.

It is therefore the object of the invention to provide a knitting machine of the kind specified above with a loop transfer means, and to design the latter such that the transfer action can be controlled in a manner similar to that of conventional knitting machines.

BRIEF SUMMARY OF THE INVENTION

The distinctive features of claim 1 are provided for the achievement of this object.

Additional advantageous features will be seen in the subordinate claims.

The invention for the first time provides a knitting machine of the kind described above, which has a transfer means. This transfer means is advantageously designed such that the patterning means needs to decide only between "knit" and "missknit" or nonknit. The knitting tools selected for knitting and therefore coupled to the corresponding cams, are then influenced by means of the transfer apparatus such that they are driven either to the usual knitting position or to a transfer position. This results not only in simplified control, which is remarkable particularly when it is to be possible to drive the knitting needles additionally to a tuck position, but also in the advantage that, by using an electronic or electromagnetic patterning apparatus, it is easy to provide such that, in the event of a power failure, all of the needles will be driven to the knit position and not, say, to the transfer position.

In a preferred further development of the invention, the retraction of the knitting tools is brought about solely by retraction cams which can be moved along the needle bed. By this measure it is possible, regardless of the gauge of the knitting machine, to provide for very close system spacing without having to sacrifice industrial knitting advantages, especially in the case of coarse gauges, such as the advantage of permitting a change in the loop length by means of movable cams (DE-OS No. 25 31 705).

The invention will be further explained below in conjunction with embodiments represented in the appended drawing.

BRIEF DESCRIPTION OF PREFERRED EMBODIMENTS

Figure 1:
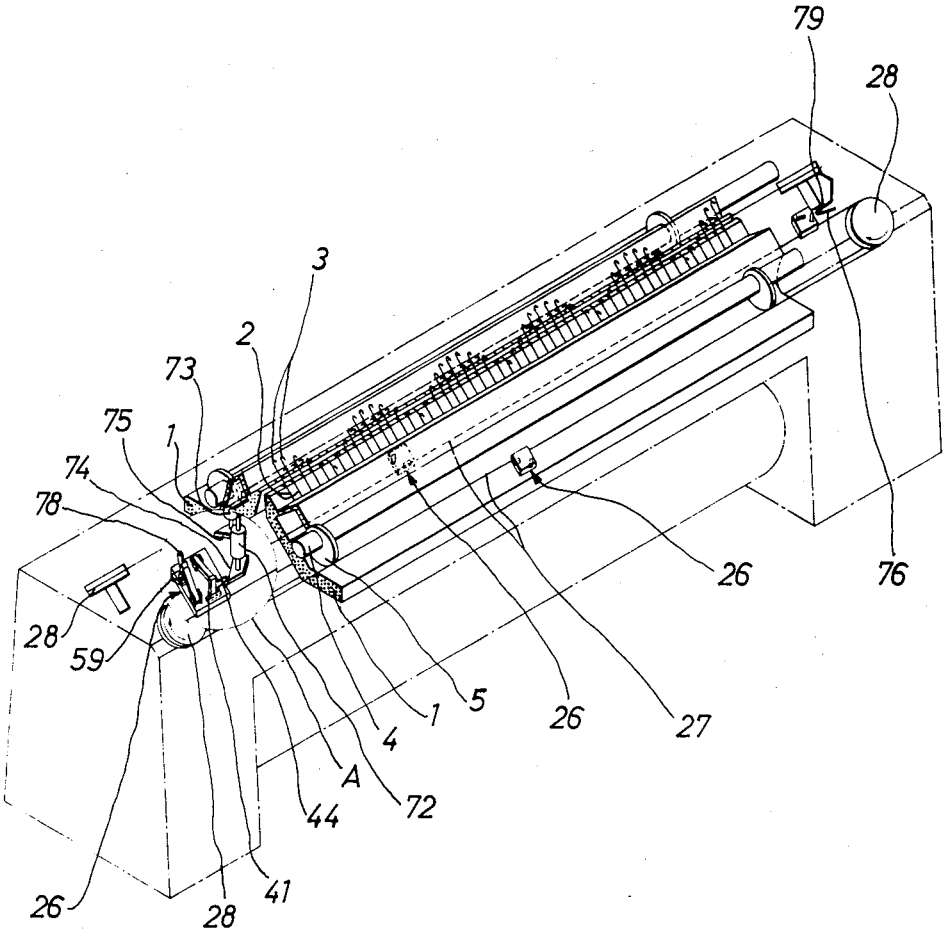
FIG. 1 is a diagrammatic and perspective overall view of a knitting machine with a transfer means in accordance with the invention.
Figure 2:
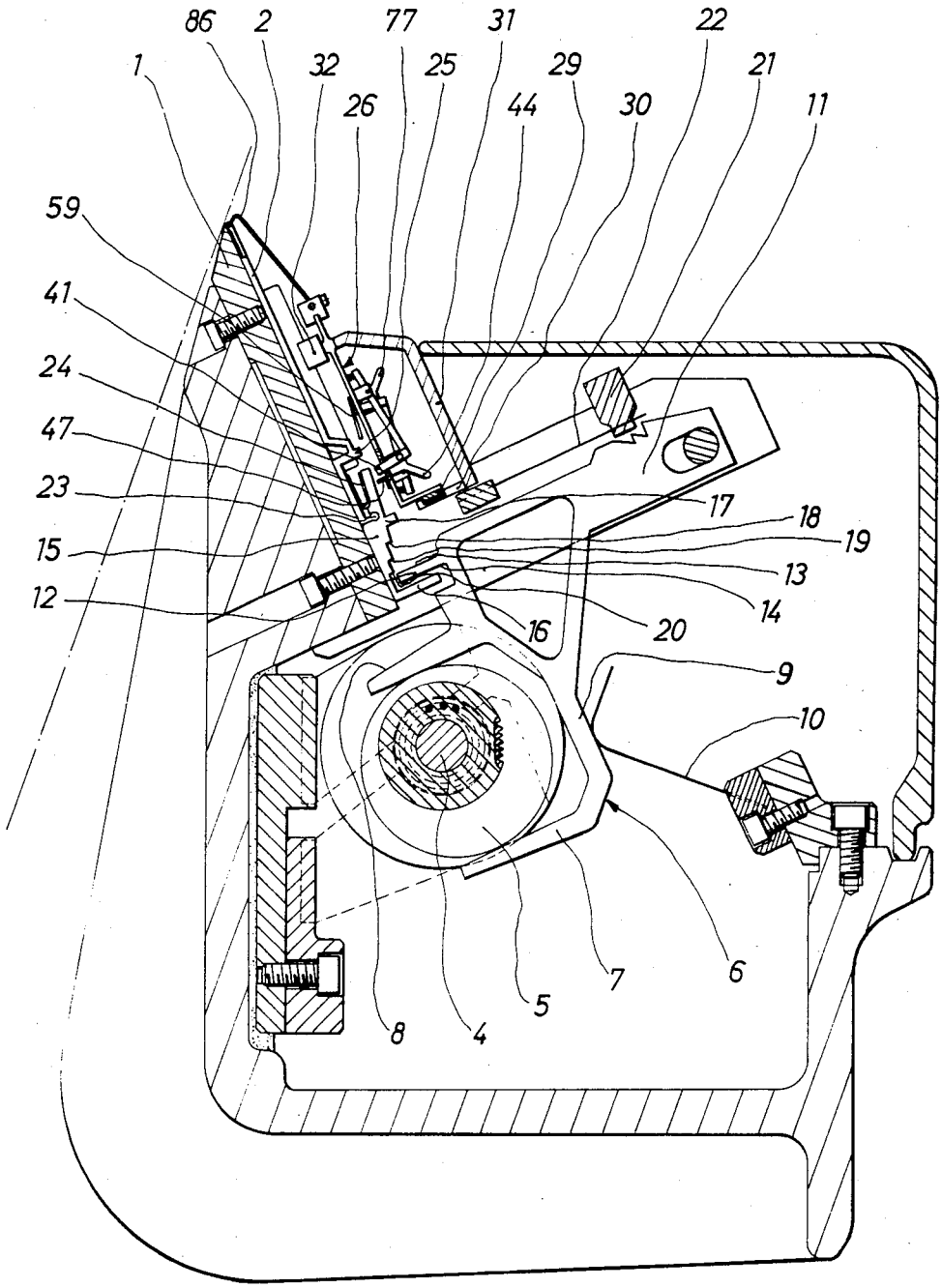
FIG. 2 is a cross section through a needle bed of the knitting machine of FIG. 1, FIGS. 3 to 6 show the elements of the transfer means which are needed for driving selected knitting needles to a transfer position, each in a view corresponding to FIG. 2, in cross sections along lines III—III to VI—VI of FIG. 7.

In FIGS. 1 and 2 there is represented a flat knitting machine having two needle beds 1 in an inverted V-shaped configuration, in whose grooves knitting tools in the form of knitting needles 2 with hooks 3, preferably bearded or latch needles, are disposed for longitudinal displacement, in a known manner. On each needle bed 1 there is journaled a drive shaft 4 on which cam disks 5 are fixedly mounted in a number corresponding to the number of the knitting needles 2.

On each cam 5 there is placed, as shown in FIG. 2, one driver 6, in the form of a fork for example, which has two substantially parallel arms 7 and 8, joined together by a bridge 9 acting as a coupling element which is engaged by a biasing spring 10 seeking to apply the bridge to the cam 5. The two arms 7 and 8 engage the cam 5 on two sides such that their points of contact with the cam 5 are situated on a line that is substantially parallel to the needle axes, so that the drivers 6 are raised and lowered parallel to the needle axes by the cams 5 upon the rotation of the drive shafts 4, and in this manner perform extension and retraction strokes. On a lateral portion facing the bridge 9 the driver 6 has a shank 11 which is mounted in a sliding and turning bearing, so that the driver 6 is on the one hand held on the cam 5 by the action of the spring 10, and on the other hand is able to slide and rotate on the basis of the sliding and turning bearing.

On an upper section of the driver 6 there is provided a projection 12 whose upper edge serves as a lifting edge 13 and whose lower edge serves as a retraction edge 14 for an associated pusher or jack means 15 disposed beneath the corresponding knitting needle 2. The projection 12 projects into a recess which is formed on the front end of the pusher 15 and extends between a projection 16 of pusher 15 which is below the projection 12 and an additional, middle projection 17 of the pusher. The bottom of the recess is given a stepped configuration and contains three steps 18, 19 and 20 acting as lifters. The top edge of projection 16 acts as a retraction means.

The projection 16 of the pusher 15 is of such a length that during a retraction stroke of the cam 5 it overlaps the projection 12 in every possible position of the driver 6. The steps 18, 19 and 20, on the other hand, are so dimensioned that the projection 12, when the pusher 15 is in the starting position seen in FIG. 2, either engages one of the steps 18 or 19 in each of the two possible engaging positions of the driver 6 and bridge 9, or, in an additional, disengaged position, lies out of reach of all three steps 18, 19 and 20.

For the operation of the knitting needles according to a pattern, a patterning means is provided which, in the embodiment represented, contains a pattern-controlled electromagnet 21 and a controlling spring 22 for each knitting needle 2. The free end of the controlling spring can be applied under bias to the pole face of the electromagnet 21 by means of a projection provided on the shank 11. If the electromagnet 21 pulls the controlling spring 22, the bridge 9 is applied by the spring 10 to the corresponding cam 5 until the lifting edge 13 engages step 19 and in the next working movement of the cam 5 drives the corresponding pusher 15 to a knit position required for the normal knitting action. If, however, the controlling spring is dropped by the holding magnet 21 in accordance with the pattern, its free end is applied selectively to one of two stops formed on the shank 11, so that either the driver 6 is arrested in a withdrawn position despite the action of the spring 10 and therefore the pusher 15 is not lifted, or else the projection 12 is pushed only so far that it engages the stop 18 and therefore lifts the pusher 15 up to a "tuck" position.

In accordance with FIG. 2, each pusher is pivotally linked by means of a pivot 23 to a knitting needle 2 that is above it, such that the needle accompanies the up-and-down movement of the pusher 15 as produced by the cam 5, independently of the angular position of the pusher 15. At the same time the pusher is normally held by a U-shaped compression spring 24, which is disposed between the knitting needle and an upper portion of the pusher above the pivot 23, in the angular position seen in FIG. 2, in which the back of its section which is situated below the pivot 23 and contains the steps 18 to 20, lies upon the needle bed 1. Each knitting needle also has a needle butt 25.

The needle butts 25 can cooperate with a plurality of cam plates 26, which as shown in FIG. 1 are fastened to endless bands 27 mounted on at least two pulleys 28 and driven in the direction of the arrow at the knitting speed by a drive that is not shown. The cam plates 26 are mounted with their bottom edges on bearing bodies 29 which are guided and supported during their passage over the needle beds 1 in the groove of a rail 30, the rail 30 being affixed to a cover 31 extending parallel and fixedly over the entire length of the corresponding needle bed 1. The upper edges of the cam plates 26, however, slide between the upper end of this cover 3 and a back guide 32. In this manner the cam plates 26 are always at the same invariable level while they are running along the needle beds 1. Each cam plate 26 can bear an adjustable retractor cam, which is not seen in FIGS. 1 and 2, and which serves for the purpose of controlling the final phase of the lowering of the knitting needles 2 by a brief action on the needle butts 25 such that the loops formed by the needles are given a preselected length according to the setting of the retractor cam.

The knitting machine thus far described differs from known knitting machines of this kind (e.g., DE-OS Nos. 25 31 705, 25 31 734, 25 31 762 and 27 01 652) only in that the drivers 6 act on the knitting needles 2 not directly but indirectly through the pushers 5, and the pushers 15 have a third step 20 whose function will be explained further below. Consequently there is no need to describe further details of the knitting machine of FIGS. 1 and 2 or its mode of operation.

In contrast to the known knitting machines of this kind, the knitting machine of the invention additionally has a transfer device for the transfer of loops formed on knitting needles of one needle bed to associated knitting needles of the other needle bed. Such transfer devices are generally known in flat knitting machines having reciprocating or circulating carriages, not only where the two needle beds are laterally offset from one another (DE-OS No. 22 28 547) but also where they are not offset (DE-AS No. 24 43 231 and PCT-OS No. 0 81/00868). In knitting machines of the kind herein described, a loop transfer with offset would have the disadvantage that the numerous knitting systems disposed along the needle beds would have to be stopped until the entire transfer operation is completed, and, especially in the production of special patterns, this would involve a considerable loss of production. In the knitting machine of the invention, the transfer operation is therefore performed preferably without offset. For this purpose the needles 2 that are to be transferred are provided, in accordance with FIGS. 3 to 6, with the known lateral spreader springs 34, which serve to spread open the loops carried by the transferring needles 2 such that, in the transfer action, the hooks 3 of the receiving knitting needles 2 will be able to enter easily into the spread loops and pick them up in a known manner. If in this case all of the knitting needles of both needle beds are provided with such spreader springs 34, the loops can be transferred selectively from all the selected knitting needles of one needle bed to the associated knitting needles of the other needle bed, and vice versa.

The transfer device of the invention contains, as its essential components, the cam plates 26 with elements (cams) mounted thereon which control the transfer operation, and a control mechanism whereby these elements are prepared for the transfer operation.

Figure 3:
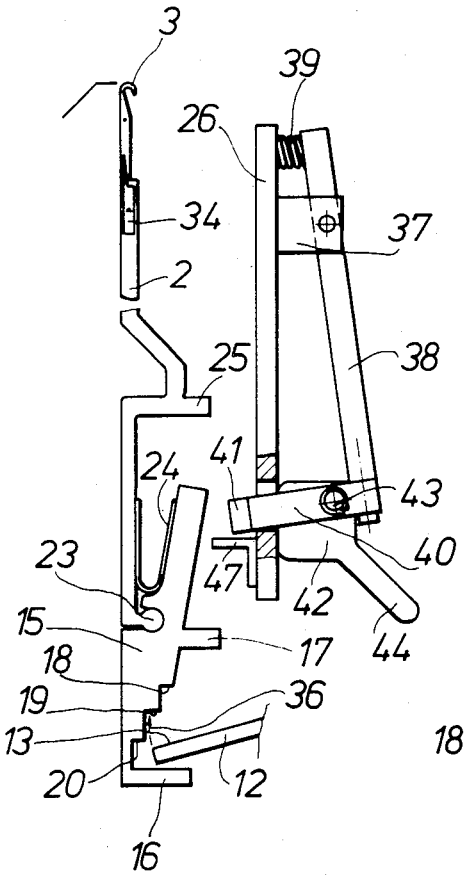
Figure 4:
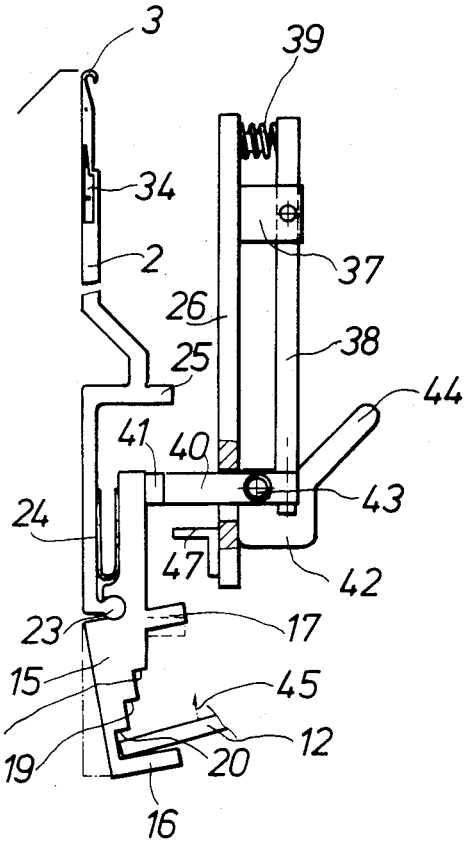

With the aid of FIGS. 3 to 6, an explanation will be given hereinafter of how the knitting needles which are to transfer a loop and also be extended beyond the normal knit position to a transfer position, are selected. FIG. 3 first shows a knitting needle and the corresponding pusher 15 in the position seen in FIG. 2. The driver 6 has been selected by the patterning apparatus for a knit, so that the lifting edge 13 of the projection 12 in the lowermost position engages the step 19 and is able to raise the knitting needle 2, connected by the pivot 23, to the normal knit position for a normal loop formation, as indicated by the arrow 36. In order to be able, with the same "knit" command patterning apparatus, to lift the knitting needle 2 also beyond the knitting position to the transfer position, a fulcrum block 37 is fastened on the side of the cam plate 26 facing away from the pushers 15, and in it a lever 38 is pivotally mounted. The one arm of the lever 38 is biased by a compression spring 39 supported on the cam plate 26. The other lever arm has a right angle section 40 which bears on its outer end passing through the cam plate 26 a friction or sliding block 41 which, when the cam plate 26 passes along the needle bed, will be opposite the sections of the pusher 15 which are pushed away from the needle bed, and will extend parallel to the needle bed.

In the normal knitting operation, the action of the compression springs 39 is counteracted by a control cam 42 which is, for example, square in profile, and which is pivotally linked, at one of its corners, on a pin 43 parallel to the cam plate 26, to the arm of lever 38 that bears the friction block 41. In the position represented in FIG. 3, the control cam 42 bears against the cam plate 26 on an edge remote from the pin 43, thereby holding the lever arm in against the pressure of the compression spring 39 at such a distance from the cam plate 26 that the friction block 41 cannot affect the pusher 15.

If, on the other hand, a transfer operation is to be initiated, the control cam 42 is rotated 90° on the pin 43 by means of a control arm 44 provided laterally on the cam 42, such that now an edge of control cam 42 that is closer to the pin 43 rests against the cam plate 26 and consequently the lever arm in question assumes, under the influence of the compression spring 39, a position substantially closer to the cam plate 26. The friction block 41 is thereby pressed against the upper sections of the passing pushers 15 (FIG. 4), and the result is that all of the pushers 15 are pivoted successively against the force of compression spring 24 about the pivot 23 such that their sections that are situated below the pivots 23 approach the corresponding drivers 6 until their steps 20 are over the lifting edges 13 of the projections 12 of those drivers 6 which have been preselected by the patterning apparatus for a knit and therefore assume the same position as in FIG. 3. The pushers 15 then assume a second pivotal position seen in FIG. 4. In the subsequent lifting stroke of the drivers 6 in the direction of an arrow 45, the corresponding pushers are therefore lifted beyond the normal knitting level by an amount corresponding to the distance between the steps 19 and 20, to the transfer position. By the appropriate configuration and arrangement of the driver 6, the cam 5, the steps 18 to 20 and the pivot 23, provision is made such that the projections 12 of those drivers 6 which are brought by the patterning apparatus to a missknit or tuck position are unable to come in contact with any of steps 18 to 20 while the pushers 15 are in the pivoted position seen in FIG. 4. This follows particularly from the fact that step 20 is the greatest distance away from the pivot 23 and step 18 the shortest, and therefore the step 18 is pivoted so little that it is unable to overlap a driver that is in the missknit position even after the pivoting operation. If step 19 should overlap such a driver 6 and the knitting needle 2 should thereby be raised to the tuck position, this would do no harm because a knitting tool that is in the tuck position will neither interfere with the transfer operation nor throw off the loop it is holding.

Figure 5:
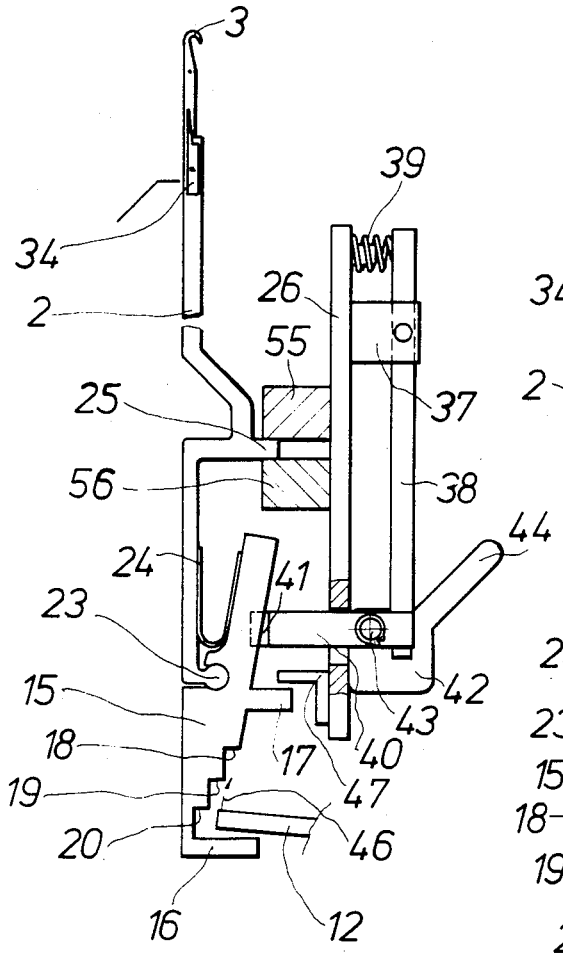

After the transfer position is reached, the pusher should be held for a period of time in the transfer position to provide enough time for the needle receiving the loop to enter properly and catch the loop held by the transferring needle. It follows from this that projection 12, when the transfer position is reached, should be disengaged from step 20, because a sufficiently long standstill time can be made available only if the lifting stroke of cam 5 and projection 12 has not yet ended when the transfer position is reached. To permit this disengagement, provision is made in accordance with the invention for the pusher 15 to slip off from the friction block 41 when the transfer position is reached. On the other hand, to reinforce the action of the compression spring 24, which by itself is not always able to rock the pusher back with the necessary reliability, an additional disengaging element is provided which operates positively. This consists, as shown in FIG. 5, of an abutment 47 fastened to the cam plate 26 and extending toward the pusher, against which the projections 17 of the pusher 15 abut precisely when the needles 2 have reached the transfer position. By the abutment of the projections 17 against the abutment edge 47, the pushers are positively rotated on the pivot 23 back to the position represented in FIG. 5, and at the same time the projections 12 are released by the steps 20. The length of the abutment parallel to the needle bed 1 and to the slider 41 is made such that the abutment begins shortly behind the bottom end of the friction block 41, in the direction of movement of the cam plate 26, and ends several needle divisions after this end. To prevent jamming of the pushers 15, provision is furthermore made for the upper edges of the projections 17, in the rotational position of the pushers 15 represented in FIG. 5, to be just underneath the abutment edge 47.

After the transfer operation is completed, the driver 6 with its projection 12 is drawn back down in the direction of the arrow 48 by the corresponding disk cam 5 (FIG. 6), the projection 12 encountering the bottom projection 16 of the pusher 15 and consequently drawing the latter and the corresponding knitting needle 2 downwardly, until the last part of the descending movement of a depressor cam 49, known in itself, fastened adjustably on the cam plate 26 and acting on the needle butt 25, is completed (DE-OS No. 25 31 705).

Figure 6:
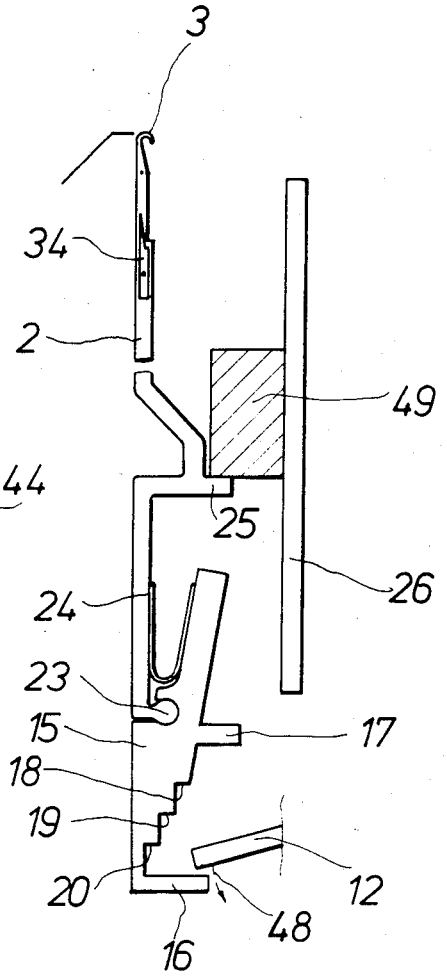
Figure 7:
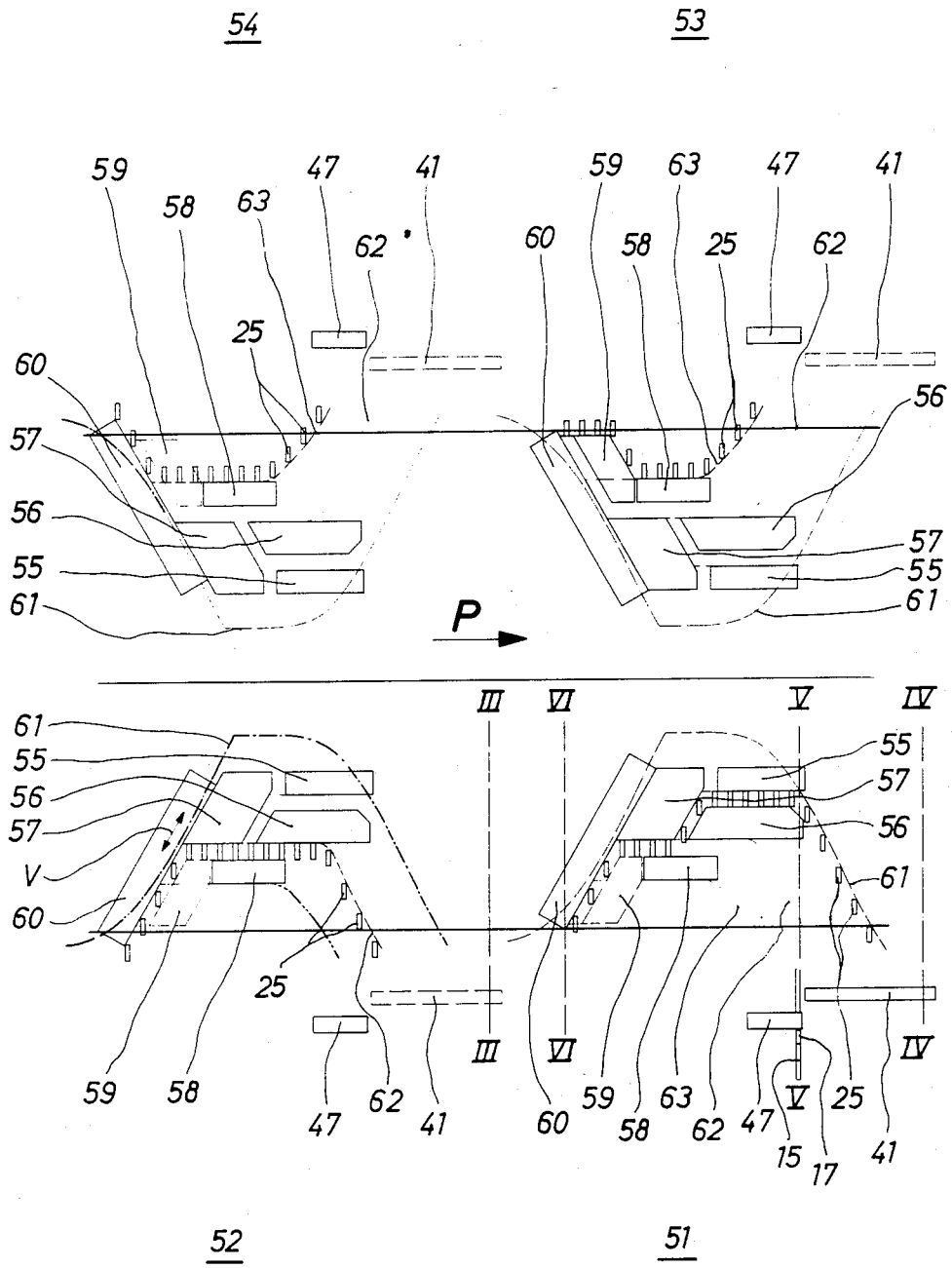
FIG. 7 is a plan view of the cams of both needle beds which are required for the control of a transfer action.

FIG. 7 shows a top plan view of the cams borne by four cam plates which are not shown. The cams are driven from left to right along the needle beds, in the direction of the arrow P. The cams represented in FIG. 7 below the line 50 are associated with the front needle bed, while the cam parts disposed above the line 50 are associated with the rear needle bed, and in each case form a cam assembly identified by reference numbers from 51 to 54. The leading cam assemblies 51 and 53 are adjusted for the transfer of loops from the knitting needles of the front needle bed to the knitting needles of the back needle bed, and the trailing cam assemblies 52 and 54 for the production of normal knit loops and tuck loops, respectively. Each cam assembly contains a lift limiter 55, a guide 56 associated therewith, a cam 57 acting in the downward direction, another guide 58 associated with the latter, and a retractor cam 60, all of them being fastened to each cam plate 26 FIGS. 3 to 6). On the forward sections of the cam assemblies 51 to 54 the friction blocks 41 and abutments 47 mounted in accordance with FIGS. 3 to 6. Also, paths 61, 62 and 63 of the upper edges of the needle butts 25 are indicated by broken lines; these are the paths which would be described during a full revolution of a disk cam 5 if the projection 12 of the driver 6 were to be engaged steadily either by step 20 or by step 19 or by step 18 of the pusher 15.

A complete transfer cycle will now be described with reference to the cam assemblies 51 and 53. To prepare for the transfer, the friction block 41 of the front needle bed is brought to the position represented in FIG. 4. Also, the drivers of all those knitting needles of the front needle bed which are to transfer a loop are selected by the patterning apparatus for "knit", i.e., the corresponding control springs 22 are steadily pulled by the electromagnets 21, while all other drivers are set for "missknit". The transfer cam 59 of the front needle bed remains inactive, so that it cannot affect the needle butts 25. In the rear needle bed, however, the drivers 6 of all those needles which are to tuck a loop are set for "tuck", i.e., the corresponding control springs 22 are released by the electromagnets 21 so late that the projections 12 of the drivers are pushed under the steps 19 of the corresponding pushers 15. The transfer cam 59 of the rear needle bed is engaged so that it can act on the needle butts 25. The friction block 41 of the rear needle bed remains disengaged.

If the cam assemblies 51 and 53 are now run past any knitting system, the friction block 41 of the cam assembly 51 will act successively on the pushers 15. The projections 12 of all drivers 6 set to knit are thus placed under the steps 20 of the corresponding pushers 15, so that the needle butts 25 of the needles connected therewith are driven along the path 61. The drivers of the knitting needles set to missknit however, leave then unaffected.

When the lift limiter 55 is reached the needle butts are held in the transfer position reached at that point (cf. FIG. 5). Since the friction block 41 shown in the lower part of the cam plate 51 is at this moment just sliding off from the corresponding pusher 15 and its projection 17 strikes against the abutment 47 now located in the area of the pusher 15, the pusher is automatically rocked back again, causing its step 20 to be disengaged from the driver 6. Consequently its projection 12 can be driven further out along a path parallel to path 61 without the pusher 15 having to follow this movement.

As the cam assembly 51 continues to move, the needle butts 25 are guided on a path suitable for the transfer operation, between the lift limiter 55 and the guide 56. At the same time the receiving needles of the rear needle bed are driven out along path 63 into the tuck position, because the corresponding drivers have been prepared accordingly by means of the pattern apparatus, so that the hooks of these knitting needles pass through the now spread loops of the needles of the front needle bed which are in the transfer position. Immediately therafter the transferring needles are pulled down by the cam part 57 to the knitting level in a manner appropriate for the transfer. Thereupon the receiving needles raised to the tuck height are pulled down by the transfer cam 59 to a point close to the pass-through position. This ends the transfer operation, i.e., the transferred loops are now in the hooks of the receiving needles of the rear needle bed. The drivers 6 of the front needle bed are not prevented by these needle movements from going further out, because their projections 12 are disengaged from the steps 18 to 20 as shown in FIG. 5.

Before the needle butts 25 of the transferring needles guided on the bottom edge of the cam 57 reach the descending portion of path 61, which would represent their being retracted by the drivers 6, the needle butts 25 run onto the retractor cam 60 and they are drawn down by the latter to the pass-through position, thus completing the transfer cycle (cf. also FIG. 6).

If while a cam assembly is passing along the needle beds no loops are to be transferred, the friction block 41 remains disengaged, as indicated by broken lines in cam assemblies 52 and 54 (cf. FIG. 3). Thus all of the pushers 15 remain in the position represented in FIG. 3, so that the projections 12 of the drivers 6 come under either step 19 or step 18 or under no step at all. Accordingly, the corresponding knitting needles are either raised to the knitting position (cam assembly 52) or to the tuck position (cam assembly 54) or in the pass-through position at slightly later moments in time than in the transfer operation. The transfer cams 59 in this case are disengaged.

The retractor cam 60 of the invention makes possible, even in small system widths, an always uniform retraction of the knitting needles regardless of whether they have been raised to the tuck or knit position, or whether the knit position is slightly higher or lower according to the gauge provided in the individual case. This results in the advantage that the same cam plate, cams and drivers can be used for all occurring pitches.

The retractor cam 60 furthermore permits a variation of the loop length. As shown in FIG. 7 for cam assembly 52 and in FIG. 8, all that is necessary for this purpose is to mount the retractor cam 60 by known means (DE-OS No. 25 31 705, 30 03 811 and 31 38 337) for displacement in the direction of an arrow V on the corresponding cam plate. Furthermore, it is desirable to associate a guide 64 with the bottom edge of the retractor cam 60 in order to assure a precise loop length even at high velocities.

Figure 8:
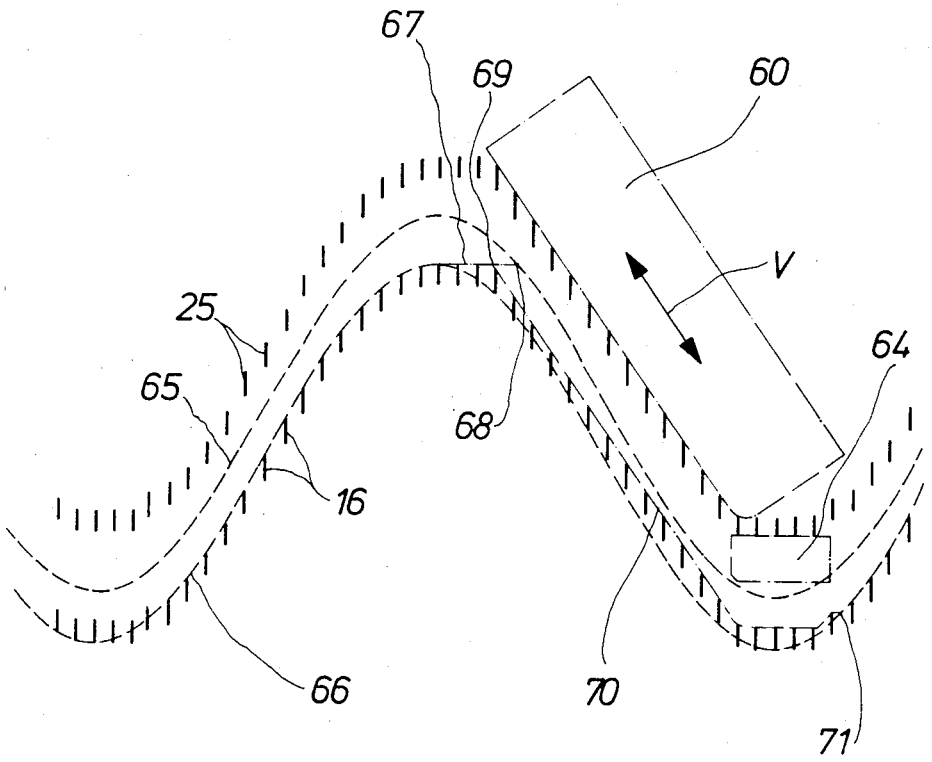
FIG. 8 is a diagrammatic representation of the individual phases of movement of the knitting tools during a full excursion and retraction.

In FIG. 8 is a diagrammatic representation of the interaction between the retractor cam 60, the drivers 6 and the knitting needles 2 in the performance of a normal knit. A broken line indicates a path 65 on which the idealized-flat projections 12 of the drivers move during the extensions and retractions. Another broken line indicates a path 66 on which the upper edges of the projections 16 of the pushers 15 would move if they were to follow the projections positively. Actually, however, there is a relatively great free play between step 19 and the top edge of projection 16, corresponding to the distance between paths 65 and 66. Therefore the top edges of projections 16 follow the path 66 precisely only during the lifting action, because at this moment the projections 12 engage the step 19 and carry it along without clearance. But if the projection 12, after passing through the crest of the path 65, starts down again, the projection 16 cannot follow immediately, because the projection 12 must first cover the clearance between step 19 and projection 16. Consequently the projections 16 first remain at a level line 67. This will continue theoretically until the prolongation of the level line 67 intersects the descending part of the path 65 at 68, for in this moment the projection 12 contacts the top edge of projection 16.

If the projection 16 were to follow the path 65, the descent of the pusher 15 would be steeper than the maximum angle of ascent of a sinker. Furthermore, different conditions would exist depending on the gauge. The retractor cam 60 is therefore adjusted so that it runs slightly ahead of the path and the projections 16 of the pushers are pulled down at a point 69 situated ahead of point 68 along a path 70. Since this path 70 is always situated between the two paths 65 and 66 until, at the beginning of the next needle excursion cycle, it again encounters the path 66 at a point 71, the projection 12 is always moving during the retractions somewhere in the area between the step 19 and the top edge of projection 16, without colliding with it. Thus, in contrast to known knitting machines of this kind (DE-OS No. 25 31 705), in which only one cam is provided for setting the loop length, it is possible to control the entire excursion stroke by means of the rotating cams 5 associated individually with the knitting needles, and to control the entire retraction stroke by means of separate cams 60, which are moved along the needle beds at the knitting speed. For similar reasons it is possible, despite the general control of the knitting needles by the cams 5, to use a number of cams 55 to 59 in order to control certain functions in a similar manner, as is commonly practiced in conventional flat knitting machines equipped with carriages.

The operation of the friction blocks 41 and transfer cams 59 is performed by means of a control mechanism. This contains, as indicated in FIG. 1, two electrically controllable magnets 72 and 73 disposed ahead of the beginning of the front needle bed, each of their downwardly projecting lift rods bearing a control cam 74 and 75, respectively. The control cam 74 is disposed in the vicinity of the control arm 44 (FIGS. 3 to 6) when the magnet 72 is actuated, so that the control arm runs onto the control cam 74 when the cam plate 26 runs past the magnet 72, and is rotated by the latter from the inoperative position seen in FIG. 3 to the working position seen in FIG. 4. If the magnet 72 is not excited, the control cam 74 is out of reach of the control arm 44. A control arm 44 that is rotated by means of the control cam 74 remains in this position until the cam plate 26 reaches the rear end of the needle bed and comes into the range of action of a stationary restore cam 76 of the control mechanism, onto which the control arm 44 runs. In this manner the control arm 44 is rotated 90° in the direction tion opposite that of control cam 74, so that it again assumes the inoperative position seen in FIG. 3, so that on the next run past the magnet 72 another selecting action can be introduced. Control arms 44 that are already in the inoperative position are not affected by the restore cam 76.

The control cam 75 can act in like manner on a control arm 78 which rotates the transfer cam 59 to the forward working position. The return of the transfer cam 59 then takes place at the end of the needle bed by means of an additional, stationary restore cam 79 acting on the control arm 78. Otherwise, the control mechanism on the rear needle bed has corresponding magnets, control cams and restore cams not represented in FIG. 1, so that the loops can be transferred selectively from the front to the rear needle bed and vice versa.

Figure 9:
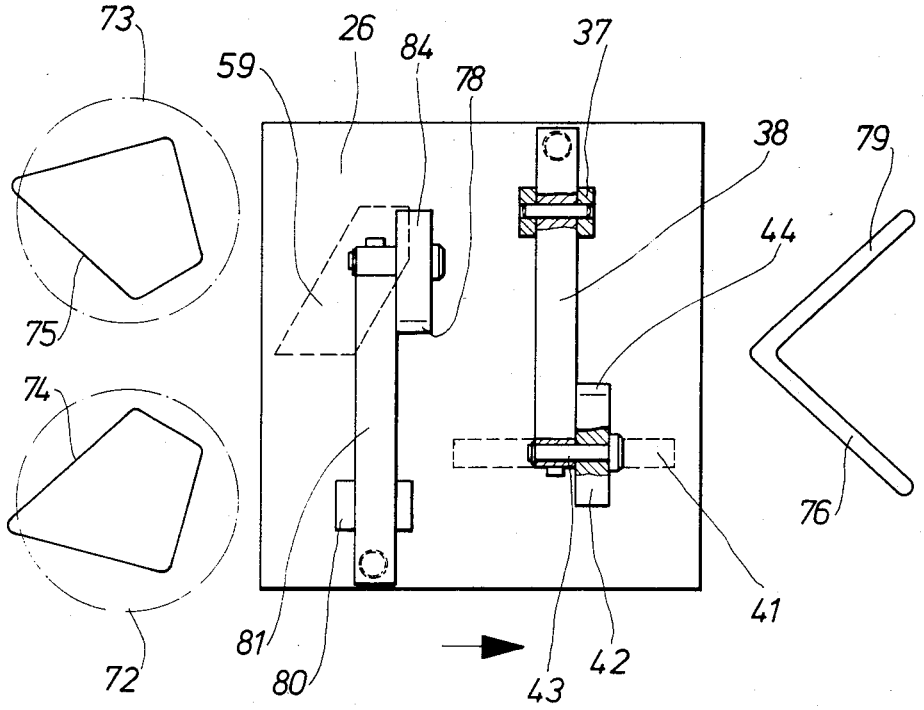
FIG. 9 is a plan view of detail "A" represented in FIG. 1, and FIGS. 10 and 11 show the positioning and control of a transfer cam of the transfer means of the invention, each in a view corresponding to FIGS. 3 to 6.

The detail A shown within a circle in FIG. 1 is enlarged in FIG. 9 and represented together with the restore cams 76 and 79 in a top plan view.

Figure 10:
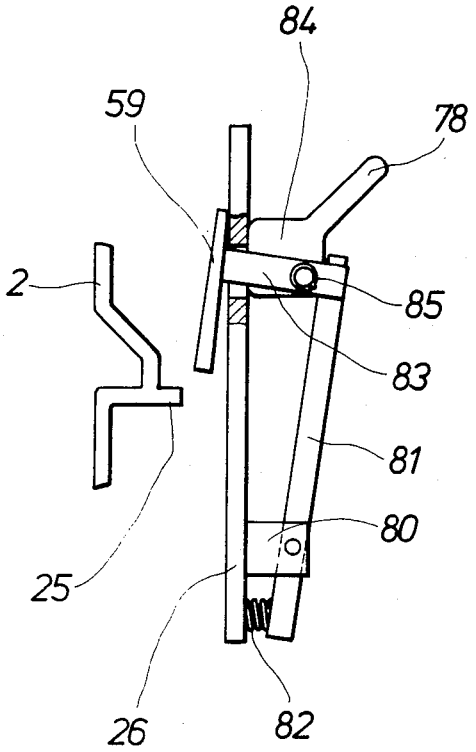
Figure 11:
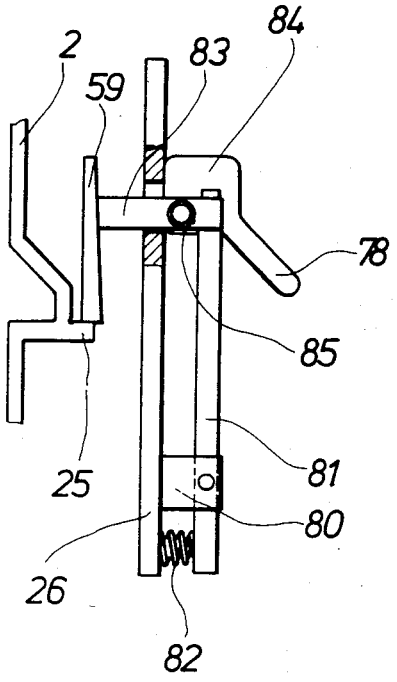

FIGS. 10 and 11 show the mounting of the transfer arm 59 on the cam plate 26 in a view similar to that of FIGS. 3 to 6, the transfer cam 59 being disposed, however, so as to be trailing the friction block 41 on the cam plate 26, in accordance with FIG. 9. For the operation of the transfer cam 59, a fulcrum 80 is fastened to the cam plate 26, and in it a lever 81 is pivotally mounted. The one arm of the lever 81 is biased by a compression spring 82 supported on the cam plate 26, while the other lever arm has a section 83 at an angle of 90°, which bears on its outer end extending through the cam plate 26 the transfer cam 59.

The operation of the transfer cam is performed, like that of the friction block 41, by means of a cam 84 of square profile, for example, which is journaled at one corner on a pin 85 on the lever 81, and which bears the operating arm 78. In the position represented in FIG. 10, the cam 84 holds the transfer cam 59 away from the needle butts 25 against the force of the compression spring 82, but in the position required in the transfer action, which is shown in FIG. 11, it permits the transfer cam 59 to act on the needle butts 25 as described in conjunction with FIG. 7.

Referring to FIG. 2, any known latch opener 86 (e.g., DE-OS No. 28 26 963) can be provided, which serves to open the latches of those needles which are to pick up a loop, and which therefore is so journaled on the cam plate 26 that it acts no later than shortly after the point indicated in FIG. 7 by the section line V—V, i.e., before the receiving needles are extended. Furthermore, a known holder can be provided, which holds the needle latches open until the hooks have passed through the loops that are to be picked up.

The invention is not limited to the embodiment described, which can be modified in many ways. Instead of the cam system represented in FIG. 7, which is of symmetrical construction on both needle beds and provides for a transfer of the loops from the front needle bed to the back needle bed and vice versa for each cam assembly, only every other of the succeeding cam assemblies, for example, needs to be provided with the cams controlling the transfer, if a loop transfer is necessary only on every other system. The cams 55, 56, 57 and 59 and especially the channels formed between them can be given whatever shape is best for the transfer action, and they can be curved, for example, instead of straight. Furthermore, the receiving needles can be extended to the position required for the receiving of the loops in other ways, for example by means of switchable cams. In this manner one selection step, namely step 18, could be eliminated, so that the patterning apparatus would have to make a selection only between "knit" and "missknit". Also, only those needles 2 which are actually to transfer loops need to be provided with a spreader spring 34. Instead of the elements provided for the control of the friction blocks 41 and transfer cams 59, other elements can be provided, and also the positions and arrangement of these elements on the knitting machine could be different. For example, it is immaterial for the described function whether the restore cams 76 and 79 are arranged directly at the rear end of the needle beds or at the start of same just ahead of the control cams 74 and 75 or anywhere between these two positions. In like manner, the control cams and electromagnets of the switching mechanism could be arranged elsewhere and could be replaced by different switching means. In the raising and lowering of the knitting needles that has been described in conjunction with FIGS. 3 to 8, it is furthermore possible to omit the projections 16 of the pushers 15 entirely, since they are needed neither in the raising nor in the lowering of the knitting needles. They offer the special advantage, however, that the lowering of the knitting needles is possible in that case even if a needle butt is defective or broken, for in this case the projections 12 of the drivers 6 provide such that those needles whose butts are broken and which therefore are not pulled down by the retractor cam 60 will be pulled down to the non-knit position by the action of projections 12 on projections 16 of the pushers 15. Furthermore, it is possible to draw down all of the extended pushers 15 and the knitting needles 2 coupled with them substantially completely in a known manner by means of the drivers 6 (DE-OS No. 25 31 705) and to operate only the last part of the retraction stroke which determines the loop length by means of a retracting cam if a complete retraction by the retraction cams 60 is not necessary. Finally, the pushers 15 could be replaced by appropriate flexible needle sections, the steps 18 to 20 could be formed on projection 12 instead of on the pusher 15, the bridges 9 affixed to the needle lifting elements could be replaced by pivoting couplers, and other patterning apparatus known in themselves (DE-OS No. 25 31 705) could be provided.

We claim:

1. A knitting machine comprising: at least two needle beds, a plurality of knitting tools movably mounted in said needle beds, a plurality of eccentric cam means rotatably mounted in said needle beds and being disposed with angular offset with respect to each other, a plurality of driving elements coupled with and alternatingly movable by said cam means in at least two opposite directions, coupling means for drivingly coupling said driving elements and said knitted tools for at least raising said knitting tools into knitting positions by movement of said driving elements, and transfer means for transferring loops formed on knitting tools of at least one of said needle beds to associated knitting tools of the other needle bed, said transfer means having cam means movable past at least said one needle bed in a direction transversely of said knitting tools for coupling said knitting tools with said driving elements such that said knitting tools are raised beyond said knitting positions into transfer positions by said movement of said driving elements.

2. A knitting machine according to claim 1, wherein a jack means is associated with each of said knitting tools and wherein said coupling means may be coupled to said jack means for drivingly coupling said driving elements to said knitting tools.

3. A knitting machine according to claim 1 or 2, wherein a patterning apparatus is provided for coupling selected ones of said knitting tools and said coupling means.

4. Knitting machine according to claim 1, characterized in that the jack means has at least two steps, one step being joined with an associated drive element in a first position of the jack means and in the coupling position of an associated coupling means, and that the cam means of said transfer means has at least one sliding block which can be moved along a needle bed at the knitting speed and acts upon the jack means such that, in a second position of the jack means and in the coupling position of the coupling means, the other step is joined to the drive element.

5. Knitting machine according to claim 4, characterized in that the jack means is pivotally mounted on the associated knitting tool.

6. Knitting machine according to claim 5, characterized in that the jack means is pivotally fastened to the associated knitting tool by means of a pivot.

7. Knitting machine according to claim 6, characterized in that the jack means can be rotated by the sliding block against the force of a spring.

8. Knitting machine according to claim 2, characterized in that the jack means has two rocking positions and three steps of which two steps, in one rocking position of the jack means, are connectable to an associated drive element by shifting an associated coupling means to one of two possible coupling positions while the third step can be connected to the drive element by rocking the jack means by means of the sliding block to the other position and shifting the coupling means to one of the two coupling positions.

9. Knitting machine according to claim 8, characterized in that the third step which can be connected by the sliding block to the drive element is intended for the lifting of the knitting tool to a transfer position, while the other two steps are intended for raising the knitting tool to a tuck position and a knit position.

10. Knitting machine according to claim 4, characterized in that the sliding block can be placed in a working position acting on the jack means and in a disengaged position leaving the jack means unaffected.

11. Knitting machine according to claim 1, characterized in that at least one drawing down cam which can be moved along the needle beds is provided for drawing down the knitting tools.

12. Knitting machine according to claim 11, characterized in that at least one adjustable drawing down cam is provided for the retraction of the knitting tools from the knitting position to the nonknit position.

13. Knitting machine according to claim 11, characterized in that at least one control cam is provided for drawing the knitting tools down out of the tranfer position to the knit position.

14. Knitting machine according to claim 11, characterized in that drawing down cams are mounted on at least two parallel-guided cam plates each associated with a needle bed.

15. Knitting machine according to claim 14, characterized in that the cam plate associated with the needle bed having the receiving knitting tools has at least one transfer cam for the premature retraction of the knitting tools from a position receiving the loops to a nonknit position.

16. Knitting machine according to claim 14, characterized in that the cam plate associated with the needle bed having the transferring knitting tools has at least a control cam and a retraction cam.

17. Knitting machine according to claim 15 or 16, characterized in that the transfer cam can be engaged in a working position affecting the knitting tools and can be disengaged to a nonworking position not affecting the knitting tools.

18. Knitting machine according to claim 10, characterized in that there are at least two parallel guided cam plates each associated with a needle bed, the cam plate associated with the needle bed having the receiving knitting tools having at least one transfer cam for the premature retraction of the knitting tools from a position receiving the loops to a nonknit position and the transfer means has a shift mechanism for the engagement and disengagement of the sliding block and/or of the transfer cam.

19. Knitting machine according to claim 18, characterized in that the shift mechanism is disposed outside of the needle beds.

20. Knitting machine according to claim 14, characterized in that the sliding block is mounted on one of the cam plates.

21. Knitting machine according to claim 10, characterized in that there are at least two parallel guided cam plates each associated with a needle bed, the cam plate associated with the needle bed having the receiving knitting tools having at least one transfer cam for the premature retraction of the knitting tools from a position receiving the loops to a nonknit position and the sliding block and/or the transfer cam is pivotally mounted on one of the cam plates, the shift mechanism having operating and restore cams intended for rocking the sliding block and/or the transfer cam.

22. Knitting machine according to claim 21, characterized in that the sliding block and/or the transfer cam is fastened on a lever pivotally mounted on the cam plate and biased by a spring.

23. Knitting machine according to claim 22, characterized in that on the lever there is pivotally fastened a control cam which has a control arm disposed in the range of action of the operating and restore cams.

24. Knitting machine according to claim 23, characterized in that at least the operating cams can be moved out of the range of action of the control arm.

25. Knitting machine according to claim 24, characterized in that an electromagnet is provided for the movement of each of the operating cams.

26. Knitting machine according to claim 7, characterized in that the sliding block is so long that the jack means slips off from it upon reaching the transfer position, is rocked back by the force of the spring and thus is disengaged from the associated drive element.

27. Knitting machine according to claim 26, characterized in that additionally a disengaging element attached to a cam plate is provided so as to rock the jack means back again.

28. Knitting machine according to claim 2, characterized in that at least one stroke limiting cam associated with the transfer position and cooperating with a jack means and/or needle butt is provided, which can be moved along at least one needle bed.

* * * * *